United States Patent [19]

Kawano et al.

[11] Patent Number: 4,627,881

[45] Date of Patent: Dec. 9, 1986

[54] COLD ROLLED STEEL SHEET HAVING EXCELLENT PRESS FORMABILITY AND METHOD FOR PRODUCING THE SAME

[75] Inventors: Tsuyoshi Kawano; Shiroh Sanagi; Koe Nakajima, all of Kitakyushu, Japan

[73] Assignee: Nippon Steel Corporation, Tokyo, Japan

[21] Appl. No.: 776,097

[22] Filed: Sep. 16, 1985

Related U.S. Application Data

[63] Continuation of Ser. No. 591,902, Mar. 21, 1984, abandoned, which is a continuation of Ser. No. 419,055, Sep. 16, 1982, abandoned.

[30] Foreign Application Priority Data

Sep. 18, 1981 [JP] Japan ..... 56-146348
Sep. 18, 1981 [JP] Japan ..... 56-146349

[51] Int. Cl.[4] ..... C21D 7/02; C21D 7/13; C21D 7/14

[52] U.S. Cl. ..... 148/12 C; 148/12 D; 420/128

[58] Field of Search ..... 148/12 C, 12 D, 36, 148/134

[56] References Cited

U.S. PATENT DOCUMENTS 3,959,029 5/1976 Matsudo et al. ..... 148/12 C
4,040,873 8/1977 Nakaoka et al. ..... 148/12 C
4,313,772 2/1982 Paulus ..... 148/12 C
4,315,783 2/1982 Akisue et al. ..... 148/134
4,368,084 1/1983 Irie et al. ..... 148/12 C
4,410,372 10/1983 Takahashi et al. ..... 148/12 C

FOREIGN PATENT DOCUMENTS 137021 11/1978 Japan ..... 148/12 C
58633 5/1979 Japan ..... 148/12 D
135616 10/1979 Japan ..... 148/12.4
97431 7/1980 Japan ..... 148/12 F
94446 7/1980 Japan ..... 148/12 C
145123 11/1980 Japan ..... 148/12 C
141555 11/1980 Japan ..... 148/12 D
38449 4/1981 Japan ..... 75/123 M

*Primary Examiner*—Wayland Stallard
*Attorney, Agent, or Firm*—Wenderoth, Lind & Ponack

[57] ABSTRACT

A cold rolled steel sheet having excellent stretchability, deep drawability, and secondary workability, and a method for producing the same, which comprises the steps of hot rolling an Al-killed steel containing not more than 0.0025%N by weight, not more than 0.010%P by weight, and not more than 0.07% C by weight, and wherein P and N have the relation of $P+5N \leqq 0.02\%$ by weight, at a temperature of 850° C. or more, cold rolling the hot rolled steel strip at a reduction of not less than 50%, and subjecting the cold rolled steel strip to continuous annealing at a temperature between the recrystallization temperature and the $A_3$ point.

8 Claims, 6 Drawing Figures

COLD ROLLED STEEL SHEET HAVING EXCELLENT PRESS FORMABILITY AND METHOD FOR PRODUCING THE SAME

This application is a continuation of now abandoned application Ser. No. 591,902 filed Mar. 21, 1984, which is a continuation of now abandoned application Ser. No. 419,055 filed Sept. 16, 1982.

BACKGROUND OF THE INVENTION

1. Field of the Invention

The present invention relates to a cold rolled steel sheet having excellent cold rolling efficiency together with excellent press formability by means of continuous annealing, and to a method for producing the same.

2. Description of the Prior Art

Since a cold rolled steel sheet having a good press formability has been heretofore manufactured with the chief aim directed to the mechanical properties of the steel sheet, the chemical composition and processing conditions thereof have been substantially decided upon. Quite recently, the thickness of a hot rolled steel strip has increased in order to save the energy required and to attain high productivity for hot strip rolling. Thus, the development of such a cold rolled steel sheet having a sufficient rupture strength in the cold rolling, and lower energy consumption required for cold rolling together with good press formability, and a method for producing the same, are now in strong demand.

As a method for producing a deep drawing steel sheet using continuous annealing, it has been known to coil a hot rolled steel sheet at high temperature in a hot strip mill. For instance, there is a method of coiling a steel containing C≦0.06% by weight at 630° C. or higher (Japan Examined Patent Application No. 1969/74); and another method for coiling a steel containing 0.01–0.10% Mn by weight, less than 0.003% S by weight, less than 0.005% P by weight, less than 0.006% N by weight, and 0.01–0.06% Al by weight at 650° C. or higher (Japan Laid-open Patent Application No. 35726/81, has also been proposed.

The former relates to an improvement in the deep drawability of the steel sheet by a method which comprises coiling the hot rolled steel strip at a high temperature in order to coarsen the carbide of the hot rolled steel strip, and the P and N contents of the steel are on a level with common Al-killed steel. The latter is directed to an improvement in the deep drawability of the steel sheet by a method which comprises extremely lowering the Mn content and S content as well as the P content in addition to the high coiling temperature, but the N content is on a level with common Al-killed steel.

However, in both of the above-mentioned methods, high temperature coiling is performed during the hot rolling step. Therefore, when the steel coil is cooled, the cooling is non-uniform throughout. As a result, the uniformity of mechanical properties in the longitudinal direction as well as the width direction is lowered. Particularly, the quality of the top and bottom ends of the coil is so extremely deteriorated as to seriously reduce the yield of the steel product. In addition, a thick scale is produced by the high temperature coiling, hence there is the disadvantage that descaling efficiency of the hot rolled steel strip is low.

SUMMARY OF THE INVENTION

It is the prime object of the present invention to provide a cold rolled steel sheet having excellent stretchability, deep drawability, and an eminent secondary workability which appears after the press working, and a method for producing the same by a continuous process.

It is another object of the invention to provide a method for producing a cold rolled steel sheet with high productivity, high yield and low energy consumption.

It is still an additional object of the invention to provide a method for the production of a cold rolled steel sheet with cold rolling by high cold reduction.

BRIEF DESCRIPTION OF THE DRAWINGS

Other objects of the present invention will become apparent to those skilled in the art from the following detailed description with reference to the accompanying drawings, in which.

DETAILED DESCRIPTION OF THE INVENTION

The inventors of the present invention conducted extensive and detailed research on press formability of low carbon Al-killed steel produced by the continuous annealing process. As a result, the inventors have found that N and P have an extremely great influence on deep drawability and stretchability. The inventors proceeded further with their research and have completed the present invention in which the Mn content is at the usual level (more than 0.10%), yet the high temperature coiling is no longer required.

The present invention is characterized by:

(a) Being different from the methods of the prior art in that high temperature coiling is unnecessary so that both productivity and yield are high;

(b) Being different from the steel obtained by the methods of prior art in that high cold reduction can be easily achieved in the cold rolling step, and by the high cold reduction the deep drawability can be much improved; and (c) In addition, a cold rolled steel sheet of highest grade stretchability and deep drawability can be easily produced by reducing the carbon content to not more than 0.005%.

First, the chemical composition of the steel of this invention will be explained below.

If the carbon content exceeds 0.07%, the steel will be hardened, and the cold rolling efficiency, one feature of the invention, will be lost. The preferred range of C is not more than 0.05%.

The most important requirement of the chemical composition which constitutes the invention is to specify a close inseparable correlation of P and N. In accordance with the present invention, it is required to specify $P \leqq 0.010\%$, $N \leqq 0.0025\%$ and satisfy the relation $P+5N \leqq 0.020\%$. These requirements must be satisfied in order to improve both press formability and cold rolling efficiency simultaneously. This will be explained in more detail hereinbelow.

It is indispensable to limit the contents of P and N.

Figure 1:
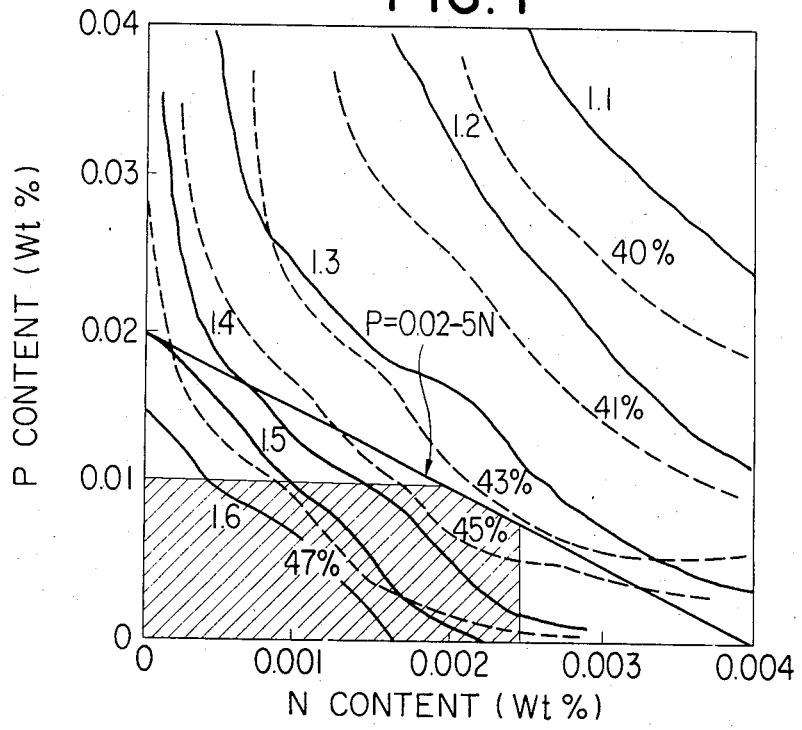
FIG. 1 is a graphic view showing the relation between the P and N content of a low carbon Al-killed steel and the $\bar{r}$ value, and the elongation of the steel sheet.
Figure 2:
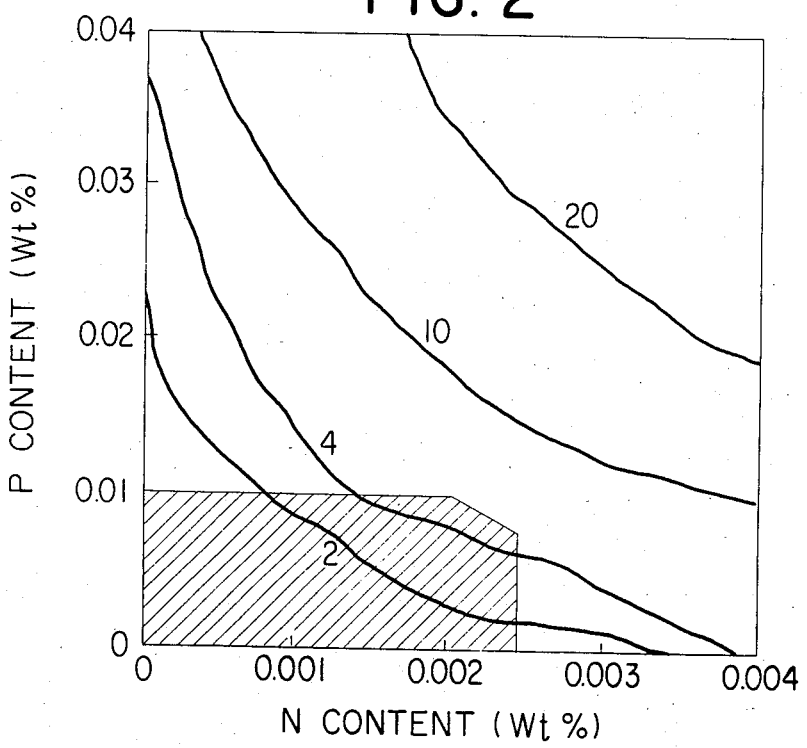
FIG. 2 is a graphic view indicating the relation between the P and N content of a low carbon Al-killed steel and rupture property during cold rolling efficiency of the steel.

As an embodiment, FIG. 1 shows the relation between the contents of P and N and the $\bar{r}$ value, and elongation in connection with a steel containing 0.02–0.040% C, 0.10–0.25% Mn, and 0.02–0.04% Al; and FIG. 2 indicates the relation between the content of P and N and the cold rolling efficiency. The relationships are shown by contour lines of the average values obtained from a large number of experiments.

Other processing conditions are as follows:

| | |
|---|---|
| Heating temperature of slab | 1050–1250° C. |
| Finishing temperature of hot rolling | >850° C. |
| Coiling temperature | 575–650° C. |
| Cold rolling reduction | 75–85% |
| Annealing condition (continuous annealing process) | 700° C. × 1 min. + 400° C. × 3 min. |
| Reduction of temper rolling | 1.2% |

As it is clearly understood in FIG. 1, the $\bar{r}$ value (solid line), favorably correlated with deep drawability, and elongation (broken line) are much improved if P is not more than 0.010% and N is not more than 0.0025% and the formula $P+5N \leqq 0.020\%$ is satisfied. Particularly, it is seen that a considerably marked effect is exhibited in the region where P is not more than 0.007% and N not more than 0.0020%. Furthermore, if N is not more than 0.0015%, the highest deep drawability is exhibited. The $\bar{r}$ value and the elongation are high despite a relatively low coiling temperature, such as 575°–650° C. FIG. 2 shows the relation between P and N content and rupture property during cold rolling.

Strip fracture was evaluated by the following test: A notch was made at the edge of hot rolled sheet (total: 20 sheets) which were 4.0 mm thick, then each sheet was cold rolled by a cold rolling mill on a laboratory scale at a reduction of 85% to a sheet 0.6 mm thick; and the thus cold rolled sheets were investigated to determine whether sheet fracture occurred or not.

FIG. 2 shows the number of fractured sheets. As shown in FIG. 2, steel fracture in the cold rolling strip scarcely occurs in the region where P is not more than 0.010% and N is not more than 0.0025% and $P+5N \leqq 0.020\%$. Further, as shown in an embodiment of the invention hereinafter, energy consumption required for cold rolling is less than that of the prior art. As described hereinafter, in the cold rolling step of the invention, a higher reduction than that of the prior art is preferred, hence this excellent cold rolling efficiency should be evaluated as of great significance in industry. Particularly, as shown in FIG. 2, such significance is conspicuous in case P is not more than 0.007% and N not more than 0.0020%.

Accordingly, the contents of P and N were specified as above taking both press formability and cold rolling efficiency of the steel sheet into account.

Mn of at least 0.05% is required in order to inhibit hot shortness due to S in the hot rolling process, but a lower limit of 0.10% Mn is preferred so as to satisfy the commonly accepted requirement $Mn/S \geqq 10$. On the other hand, however, if Mn exceeds 0.40%, Mn hardens the steel and lowers press formability. If more eminent deep drawability is required, not more than 0.30% Mn is preferred.

Al of at least 0.005% is required in order to kill the steel and fix N in the steel as AlN. On the other hand, if Al exceeds 0.05%, the steel sheet will be hardened. The cost will also be higher. The preferred range is 0.010–0.040% Al.

In order to inhibit the hot shortness, S should be specified to satisfy $Mn/S \geqq 10$ as is usual, and S is preferred to be not more than 0.015% from the viewpoint of cold workability.

The chemical composition of the steel in accordance with the present invention has been described in the foregoing. In order to further improve the characteristics of the invention, such an element as B or Cr which forms carbide or nitride may be suitably added in the commonly accepted range.

To further enhance the cold workability of the steel sheet, B may be added to the Al-killed steel, whereby much better workability and cold rolling efficiency can be achieved without any loss of the merit of the present invention. In case B is added, $B/N \leqq 1.5$ is preferred.

In addition, if Cr is added, it is preferred to be not more than 0.10%, as is conventional.

In accordance with the present invention, a cold rolled steel sheet favored with a combination of highest stretchability, deep drawability and embrittlement after deep-drawing (referred to as secondary workability hereinafter), all of the highest degree, can be produced by adding additional requirements, not more than 0.005% C and $P \leqq 4C$ specified between P and C.

The upper limit of C has been specified as 0.005% in order to obtain stretchability and deep drawability of the highest degree. However, the mere reduction of the carbon content tends to bring about secondary working cracks after press forming. For instance, if the carbon content is reduced to not more than 0.005%, it is known that secondary working cracks will occur, although the degree of the press working is not great. It has been found from a large number of experimental results that to prevent the occurrence of secondary working cracks notwithstanding such a severe press working operation as about 3.5 drawing ratio, it is most effective to specify P as not more than 0.010% while maintaining the relation $P \leqq 4C$ so as to reduce P as well as C. The decrease of P together with the decrease of C contributes to the improvement of deep drawability as well as stretchability. As described hereinafter, it is understood that the reduction of P only also contributes to the improvement of deep drawability and stretchability. Therefore, in accordance with the present invention, the decrease of C is accompanied with the simultaneous decrease of P, hence its advantageous effect is much greater than in the steel of the prior art. In addition, to exhibit the characteristics of the invention to the utmost, it is preferred to specify C not more than 0.004% and $P \leqq 3C$.

Thus, in the case of extremely low carbon steel, the limiting of P and N has very great significance.

Figure 3:
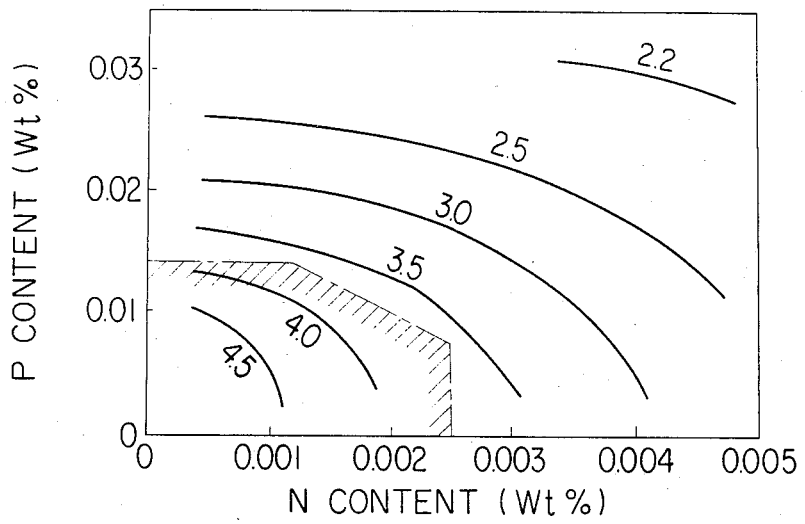
FIG. 3 is a graphic view showing the relation between the secondary workability and the P and N content of an extremely low carbon Al-killed steel.
Figure 4:
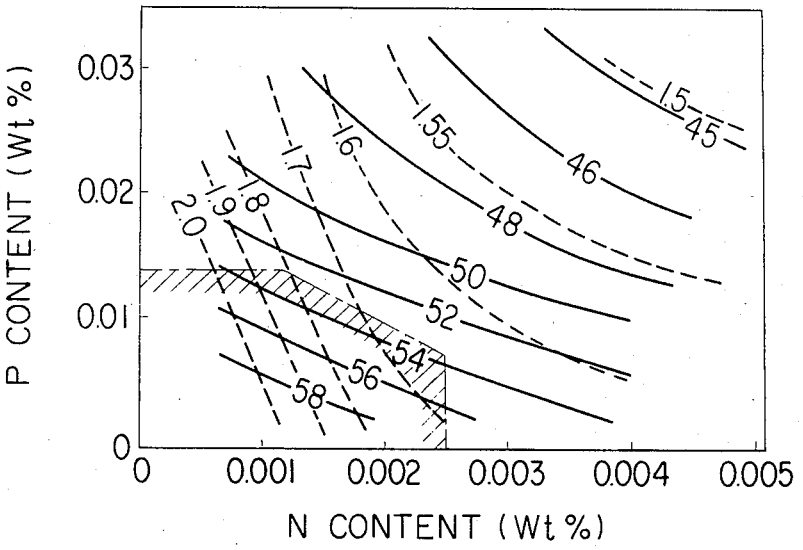
FIG. 4 is a graphic view indicating the relation between the elongation, and the $\bar{r}$ value and the P and N content of an extremely low carbon Al-killed steel.

FIG. 3 shows an embodiment of the relation between the contents of P and N and the secondary workability in connection with a steel containing 0.003–0.004% C, 0.20–0.25% Mn, and 0.01–0.04% Al; and FIG. 4 shows the relation between the content of P and N and the $\bar{r}$ value, elongation. The relationships are shown by contour lines based on average values obtained from a large number of experiments. In addition, in FIGS. 3–4, the upper limit of P is indicated as 0.014% (P=4C) in terms of C≈0.0035%.

Other processing conditions are as follows:

| | |
|---|---|
| Heating temperature of hot rolled slab | 1050–1200° C. |
| Finishing temperature of hot rolling | higher than 890° C. |
| Coiling temperature of hot rolled coil | 550–650° C. |
| Reduction of cold rolling | 80–85% |
| Annealing condition (continuous annealing process) | 750° C. × 1 min. |
| Reduction of temper rolling | 1.0% |

By the way, the examination of secondary workability shown in FIG. 3 is conducted as follows: steel sheets are drawn to cups with various drawing ratios, each of which is subjected to expansion with a conical punch at the temperature of 0° C., and at this time an investigation is made whether brittle rupture occurred on the thus formed cups. The secondary workability is evaluated with the greatest drawing ratio where no brittle rupture occurs. The numerals in FIG. 3 show the greatest drawing ratio where the secondary working cracks will not occur, and the greater the numeral the better the secondary workability.

In FIG. 4, the solid line refers to the elongation, the broken line to the $\bar{r}$ value, and the numerals refer to the elongation and the $\bar{r}$ value, respectively.

As clearly seen in FIGS. 3–4, P has an influence not only on the secondary workability but also on the elongation, strongly correlated with the stretchability, and the $\bar{r}$ value, strongly correlated with the deep drawability. At the range of P≦0.010%, an improved effect of elongation becomes extremely great while, at the same time, the $\bar{r}$ value is much improved with the reduction of P.

Moreover, with reference to N, it has been found that the secondary workability is improved with the reduction of N, and in the range of N≦25PPM the $\bar{r}$ value is remarkably improved, and the elongation is also improved.

By the above-mentioned method, an extremely low carbon cold rolled steel sheet having more than 52% elongation, more than a 1.6 $\bar{r}$ value, and more than a 3.5 drawing ratio, without secondary working cracks can be obtained. It is understood that the above characteristics can be much more improved by further reducing the contents of P and N to a lower level, and besides, a cold rolled steel sheet favored with stretchability, deep drawability, and secondary workability of the highest degree can be produced by limiting P≦0.007% and N≦0.0020%.

The fundamental compositions of the extremely low carbon steel of this invention have been described, and in addition thereto, Ti, Nb and B can be added in a suitable amount. Ti, Nb or B combine with N and C, and the present invention aims at lower C and N, so that the characteristics of the invention can be enhanced by the addition of these elements. In the addition of the elements, one or more of Ti≦0.10%, Nb≦0.10%, and B≦0.0030% can be added. When the content of each element exceeds its upper limit, its effect is saturated and also raises the sheet cost.

The steel sheet containing the above chemical composition is produced in the following way.

The molten steel is produced by the conventional steel making method, and in the manufacture of extremely low carbon steel, the molten steel is subjected to vacuum degassing treatment, and then made into slabs by the conventional method.

In the present invention, the finishing temperature of hot rolling should be at least 850° C. If it is less than 850° C., the deep drawability will be lowered. The temperature for heating the steel slab is not essential in the present invention. Accordingly, it is preferred to heat at a temperature not more than 1200° C. from the viewpoint of energy saving and obtaining better press formability as described hereinafter.

Also, hot slabs obtained by the continuous casting or break-down mill may be directly hot rolled, or hot-charged into a slab heating furnace. Preferable hot rolling conditions are as follows.

The finishing entry temperature of the finishing tandem stands is preferred to be not higher than 1000° C., so that the total reduction in the lower temperature range can become large. For instance, the reduction of the final two-pass is preferred to be 40% or more. The finishing temperature is preferred to be higher than the $Ar_3$ point (referred to as $A_3$ hereinafter), and thereafter the strip is forcedly cooled as soon as possible after rolling at a cooling rate more than 30° C. per second. By the above processing conditions, the characteristics of the present invention will be exceedingly exhibited. This advantageous effect is particularly great in the extremely low carbon steel. The slab heating temperature may be preferred to be not higher than 1100° C. in order to make the finish entry temperature not higher than 1000° C.

Referring to the coiling temperature of this invention, a high coiling temperature is not required, which is characteristically different from the prior art. The coiling temperature of a low carbon Al-killed steel is preferred to be higher than 575° C. in this invention in order to insure an $\bar{r}$ value of more than 1.4, required for a deep drawing quality.

Figure 5:
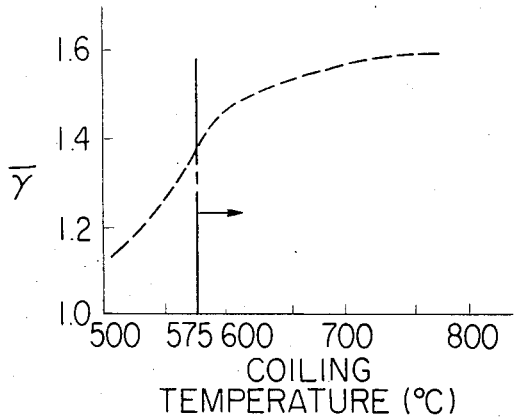
FIG. 5 is a graphic view showing an embodiment of the relation between the coiling temperature of the low carbon Al-killed steel and the $\bar{r}$ value of a steel sheet.

FIG. 5 shows the relation between the coiling temperature and the $\bar{r}$ value in connection with a steel containing 0.03%C, or 0.20%Mn, 0.007P, 0.0015%N, and 0.030%Al. The annealing condition is 700° C.×1 minute+400° C.×3 minutes (continuous annealing process).

As shown in FIG. 5, the higher coiling temperature such as 700° C. is not required as in the prior art, and a steel sheet of good deep drawability can be obtained even when coiled at a temperature lower than 630° C. When a softer steel sheet is required, the coiling temperature may be higher than 630° C. Even in this case, as described in the following example, the present invention has a distinguished advantage in that even with a high coiling temperature (for instance, 750° C.), the quality variation in the longitudinal direction and width direction of the coil is extremely small as compared with the prior art.

In the case of the extremely low carbon Al-killed steel, the characteristics of the invention are not affected by the coiling temperature at all. Therefore, the coiling temperature is preferred to be 550°–650° C. from the viewpoint of pickling or descaling efficiency.

The hot rolled coil is subsequently subjected to descaling and cold rolling. Cold rolling is carried out at a reduction of at least 50% as in the conventional method. However, it has been confirmed that the cold workability of the steel of this invention is much improved with a higher reduction of the cold rolling than the common steel of prior art. The results thereof are shown in FIG. 6.

Figure 6:
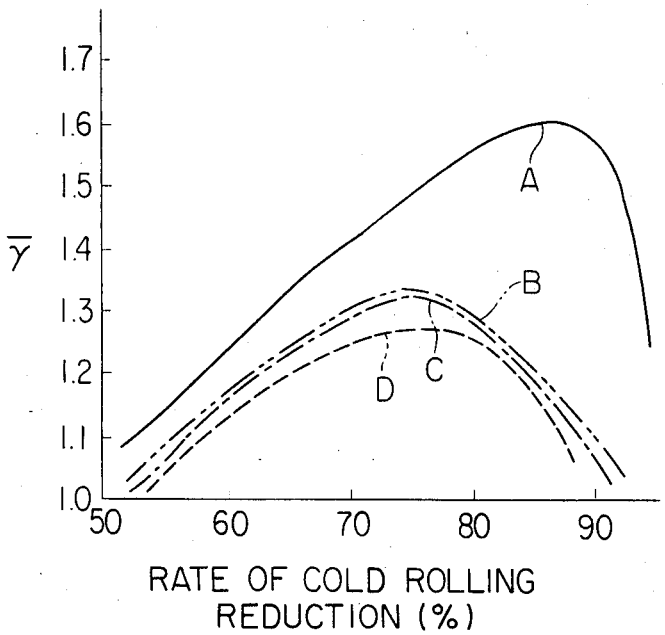
FIG. 6 is also a graphic view showing an embodiment of the relation between the cold rolling reduction and the $\bar{r}$ value of a low carbon Al-killed steel.

The chemical composition and the hot rolling conditions of the samples illustrated in FIG. 6 are shown in Table 1.

TABLE 1

| | | Chemical Composition (wt. %) | | | | | Hot Rolling Conditions | |
|---|---|---|---|---|---|---|---|---|
| | | | | | | | Finishing Temperature | Coiling Temperature |
| | | C | Mn | P | Al | N | (°C.) | (°C.) |
| This invention | Steel A | 0.030 | 0.20 | 0.007 | 0.025 | 0.0012 | 860 | 600 |
| Comparison | Steel B | " | " | 0.020 | " | 0.0020 | " | " |
| | Steel C | 0.030 | " | 0.015 | " | 0.0030 | 865 | " |
| | Steel D | 0.030 | " | 0.020 | " | 0.0040 | 873 | " |

The annealing condition is 750°×1 minute+400° C.×3 minutes.

As clear in FIG. 6, the steel A of this invention has a high $\bar{r}$ value, and it is seen that the cold reduction where the $\bar{r}$ value reaches the peak is about 87%. When the cold reduction becomes more than 70%, an $\bar{r}$ value more than 1.4 is obtained. Therefore the cold reduction is preferred to be more than 70% and not more than 90% in order to obtain a high $\bar{r}$ value. Most preferable range is 75–90%.

On the other hand, however, comparative steels B, C and D have low $\bar{r}$ values, and the cold reduction where the $\bar{r}$ value reaches its peak is about 75%.

This high cold rolled reduction and thereby high $\bar{r}$ value is one of the features of the present invention. Moreover, the steel of the invention has excellent cold rolling efficiency, so that there is no problem even if the cold reduction is increased to 70–90%.

The recrystallization annealing is carried out at a temperature between the recrystallization temperature and the $A_3$ point by a continuous annealing method and then the strip is subsequently cooled, and, if necessary, subjected to an overageing. The method of this invention can be applied to any continuous annealing method. Under typical annealing conditions, the steel is subjected to the recrystallization at a soaking temperature of 650°–850° C. for a period of not more than 5 minutes, then cooled, and subjected to overageing at a temperature of 200°–450° C. for a period of not more than 10 minutes. To improve the deep drawability much further, the soaking temperature is preferred to be higher than 700° C.

In addition, the typical annealing conditions to be applied to the extremely low carbon Al-killed steel are as follows: the steel is subjected to recrystallization at a soaking temperature of 700°–800° C. for a period of not more than three minutes and is then cooled. In this case, the overageing treatment is not required, but it may be conducted at a temperature of 200°–450° C. for a period of less than 5 minutes.

The steel strip thus annealed is subjected to temper rolling, if necessary, to produce the final product.

Since the steel manufactured in accordance with the method of the present invention can be subjected to any surface treatment with no loss of the feature of the invention, it can be applied to any surface treatment, such as the manufacture of tinplate, galvanized sheets, turn sheets, etc.

EXAMPLE 1

The steels shown in Table 2 were produced in a converter; the molten steel was cast in a continuous casting mold to obtain a slab; the slab was reheated to a temperature of 1050°–1200° C.; the hot slab was hot rolled into a strip 4.0 mm thick under the hot rolling conditions listed in Table 2; the hot rolled strip was descaled and the descaled hot rolled strip was cold rolled to a strip 0.8 mm thick, which was subjected to recrystallization annealing at 700° C. for one minute by continuous annealing; then it was cooled and subjected to an overageing treatment at 400° C. for one minute; and was finally subjected to temper rolling at a reduction of 1.3% to obtain a finished product.

Table 2 also shows the mechanical properties and the cold rolling efficiency of the cold rolling process in connection with the steel sheet produced by the above method. The cold rolling efficiency is shown by an energy consumption ratio of the average value as compared with the prior art (common low carbon Al-killed steel) for the cold rolling. The steel sheet fracture property was evaluated by the total number of fractures occurring in the examination test wherein a notch was made at the edge of every hot rolled sheet (total: 20 sheets), then it was cold rolled with the reduction of 85% by a laboratory cold rolling mill to a sheet 0.6 mm thick.

The tensile test piece is No. 5 as specified by JIS, and the mechanical property was indicated by the average value of the whole length of the coil, and the difference in $\bar{r}$ value between $\bar{r}M$ (the center of the longitudinal direction of the coil) and $\bar{r}B$ (the tail end of the longitudinal direction of the coil) is also shown.

It is seen that every steel listed within the scope of the present invention has a low yield point, a high elongation, a high $\bar{r}$ value, good press formability, and excellent cold rolling efficiency despite a coiling temperature less than 630° C.

Coils E and F are the same except for the finishing hot rolling conditions. It is seen that the $\bar{r}$ value of the coil F wherein the finishing hot rolling entry temperature is lower than that of the coil E is higher. The comparative steel coil N whose coiling temperature was 750° C. has a fairly good $\bar{r}$ value and elongation, but the difference in $\bar{r}$ value ($\bar{r}M-\bar{r}B$) is very large, so that the quality fluctuation in the longitudinal direction of the coil is remarkable and therefore product yield is low.

On the other hand, however, the coil H of the present invention which had a coiling temperature of 750° C. has a high $\bar{r}$ value compared with the coil A and coil N, and also the difference in $\bar{r}$ value ($\bar{r}M-\bar{r}B$) is very small. Thus it is seen that the quality fluctuation in the coil of this invention is not so great as that of the prior art.

TABLE 2

| | Coil No. | Chemical Composition of Steel (wt %) C | Mn | P | S | Al | N | P + 5N | B | Hot Rolling Conditions: Slab heating temp. (°C.) | Finishing entry temp. (°C.) | Finishing temp. (°C.) | Coiling temp. (°C.) |
|---|---|---|---|---|---|---|---|---|---|---|---|---|---|
| This Invention | A | 0.038 | 0.20 | 0.006 | 0.005 | 0.020 | 0.0015 | 0.0135 | — | 1100 | 980 | 860 | 575 |
| | B | 0.050 | 0.20 | 0.007 | 0.005 | 0.020 | 0.0020 | 0.0170 | — | " | " | " | 600 |
| | C | 0.045 | 0.20 | 0.005 | 0.013 | 0.030 | 0.0009 | 0.0075 | — | " | 970 | " | 650 |
| | D | 0.033 | 0.35 | 0.010 | 0.011 | 0.010 | 0.0008 | 0.0140 | — | 1200 | 1030 | 875 | 620 |
| | E | 0.040 | 0.20 | 0.007 | 0.011 | 0.040 | 0.0012 | 0.0130 | — | 1150 | " | 880 | 625 |
| | F | 0.040 | 0.20 | 0.007 | 0.011 | 0.035 | 0.0012 | 0.0130 | — | 1150 | 960 | 860 | 625 |
| | G | 0.045 | 0.20 | 0.005 | 0.013 | 0.025 | 0.0010 | 0.0100 | 0.0012 | " | 980 | 855 | 625 |
| | H | 0.038 | 0.20 | 0.005 | 0.005 | 0.020 | 0.0015 | 0.0125 | — | " | 1000 | 880 | 750 |
| Comparison | I | 0.040 | 0.20 | 0.009 | 0.016 | 0.040 | 0.0035 | 0.0265 | — | 1200 | 1000 | 880 | 625 |
| | J | 0.050 | 0.20 | 0.020 | 0.005 | 0.020 | 0.0012 | 0.0260 | — | 1150 | 980 | 860 | 650 |
| | K | 0.033 | 0.35 | 0.020 | 0.011 | 0.010 | 0.0035 | 0.0375 | — | 1200 | 1010 | 875 | 620 |
| | L | 0.045 | 0.20 | 0.019 | 0.013 | 0.025 | 0.0035 | 0.0365 | — | 1100 | 990 | 855 | 625 |
| | M | 0.085 | 0.30 | 0.015 | 0.009 | 0.030 | 0.0020 | 0.0250 | — | " | " | 865 | 600 |
| | N | 0.038 | 0.20 | 0.018 | 0.013 | 0.020 | 0.0040 | 0.0380 | — | 1150 | 1000 | 875 | 750 |

| | Coil No. | Cold rolling efficiency: Sheet fracture | Energy consumption | Mechanical Properties of Steel Sheet: Y.P. (Kg/mm²) | T.S. (Kg/mm²) | El (%) | $\bar{r}$ value | $\bar{r}_M-\bar{r}_B$ |
|---|---|---|---|---|---|---|---|---|
| This Invention | A | 3 | 0.90 | 20.2 | 31.4 | 45. | 1.40 | 0.15 |
| | B | 4 | 0.90 | 19.3 | 31.2 | 45. | 1.40 | 0.15 |
| | C | 2 | 0.83 | 19.7 | 32.1 | 48. | 1.65 | 0.10 |
| | D | 3 | 0.82 | 18.9 | 31.4 | 47. | 1.50 | 0.10 |
| | E | 2 | 0.87 | 19.1 | 31.3 | 47. | 1.43 | 0.15 |
| | F | 2 | 0.90 | 19.1 | 31.3 | 47. | 1.65 | 0.15 |
| | G | 2 | 0.80 | 18.9 | 30.7 | 48. | 1.55 | 0.15 |
| | H | 3 | 0.90 | 19.7 | 31.4 | 46.0 | 1.60 | 0.15 |
| Comparison | I | 10 | 1.0 | 24.8 | 33.0 | 43.0 | 1.28 | 0.20 |
| | J | 6 | 1.03 | 24.1 | 33.2 | 43.0 | 1.29 | 0.20 |
| | K | 16 | 1.03 | 25.0 | 34.2 | 40.0 | 1.15 | 0.10 |
| | L | 17 | 1.10 | 25.1 | 34.6 | 40.0 | 1.10 | 0.08 |
| | M | 7 | 1.03 | 24.0 | 35.1 | 41.0 | 1.10 | 0.03 |
| | N | 19 | 1.05 | 18.9 | 31.7 | 45.0 | 1.40 | 0.30 |

EXAMPLE 2

The steels listed in Table 3 were produced in a converter. The molten steel was subjected to vacuum degassing to lower the carbon content to a predetermined level, and then was cast in a continuous casting mold to obtain a slab. The slab was reheated to a temperature of 1050°-1200° C. and hot rolled under the conditions indicated in Table 3. The hot rolled strip was cold rolled to a 0.8 mm thickness and then was annealed and subjected to temper rolling at 1.5% reduction.

The properties of the cold rolled sheet thus obtained are listed in Table 3.

The tensile test piece was No. 5 specified by JIS; and the secondary workability is shown by the largest drawing ratio where no brittle rupture occurs in drawn cups with various drawing ratios under the conical expansion test at 0° C.

Each of the extremely low carbon steel sheets produced within the scope of the present invention has not only an eminent elongation strongly correlated with the stretchability, but also an excellent $\bar{r}$ value strongly correlated with the deep drawability, and further, a distinguished secondary workability. Hence it can be said that the steel sheet of the present invention has press formability of the highest degree.

TABLE 3

| | Coil No. | Chemical Composition of Steel (wt. %): C | Si | Mn | P | S | Al | N | Other elements | P − 4C | P + 5N | Hot Rolling Conditions: Finishing entry temp. (°C.) | Finishing temp. (°C.) | Coiling temp. (°C.) |
|---|---|---|---|---|---|---|---|---|---|---|---|---|---|---|
| This Invention | 1 | 0.0030 | 0.01 | 0.25 | 0.008 | 0.010 | 0.025 | 0.0010 | — | <0 | 0.0130 | 1015 | 900 | 625 |
| | 2 | 0.0040 | 0.01 | 0.20 | 0.005 | 0.011 | 0.030 | 0.0015 | — | <0 | 0.0175 | 980 | 890 | 600 |
| | 3 | 0.0020 | 0.01 | 0.30 | 0.006 | 0.009 | 0.035 | 0.0015 | — | <0 | 0.0165 | 1015 | 920 | 600 |
| | 4 | 0.0020 | 0.01 | 0.30 | 0.006 | 0.009 | 0.035 | 0.0015 | — | <0 | 0.0165 | 970 | 900 | 600 |
| | 5 | 0.0040 | 0.02 | 0.27 | 0.010 | 0.007 | 0.030 | 0.0015 | Ti = 0.05 | <0 | 0.0175 | 1010 | 925 | 575 |
| | 6 | 0.0030 | 0.02 | 0.26 | 0.006 | 0.009 | 0.020 | 0.0012 | B = 0.0010 | <0 | 0.0140 | 975 | 900 | 600 |
| | 7 | 0.0035 | 0.01 | 0.15 | 0.007 | 0.010 | 0.020 | 0.0010 | Nb = 0.02 | <0 | 0.0120 | " | " | 600 |
| Comparison | 8 | 0.0035 | 0.02 | 0.23 | 0.012 | 0.008 | 0.025 | 0.0030 | — | <0 | 0.0270 | 1000 | 925 | 600 |
| | 9 | 0.0020 | 0.02 | 0.29 | 0.013 | 0.010 | 0.030 | 0.0013 | — | >0 | 0.0195 | " | " | 625 |

TABLE 3-continued

| | | | | | | | | | | | | | |
|---|---|---|---|---|---|---|---|---|---|---|---|---|---|
| 10 | 0.0040 | 0.02 | 0.15 | 0.017 | 0.004 | 0.035 | 0.0020 | — | >0 | 0.0270 | 995 | 900 | 625 |

| | | | | | Mechanical Properties of Product | | | | |
|---|---|---|---|---|---|---|---|---|---|
| | Coil No. | Cold rolling reduction (%) | Annealing Condition | Y.P. (Kg/mm²) | T.S. (Kg/mm²) | El. (%) | $\bar{r}$ | Secondary Workability* |
| This Invention | 1 | 87 | 775° C. × 1 min. 400° C. × 3 min. | 16.0 | 30.0 | 58 | 2.0 | 4.5 |
| | 2 | 75 | 775° C. × 1 min. 400° C. × 3 min. | 16.5 | 28.5 | 56 | 1.8 | 4.0 |
| | 3 | 78 | 775° C. × 1 min. 400° C. × 3 min. | 16.5 | 29.0 | 56 | 1.8 | 4.0 |
| | 4 | 78 | 775° C. × 1 min. 400° C. × 3 min. | 16.7 | 29.5 | 55 | 2.1 | 4.0 |
| | 5 | 80 | 775° C. × 1 min. 400° C. × 3 min. | 15.0 | 30.5 | 54 | 2.0 | 4.0 |
| | 6 | 78 | 775° C. × 1 min. 400° C. × 3 min. | 16.0 | 29.0 | 56 | 1.9 | 4.0 |
| | 7 | 80 | 775° C. × 1 min. 400° C. × 3 min. | 17.0 | 30.0 | 55 | 2.0 | 4.0 |
| Comparison | 8 | 75 | 775° C. × 1 min. 400° C. × 3 min. | 18.5 | 30.5 | 50.0 | 1.6 | 3.0 |
| | 9 | 87 | 775° C. × 1 min. 400° C. × 3 min. | 20.0 | 32.0 | 52 | 1.6 | 3.0 |
| | 10 | 80 | 775° C. × 1 min. 400° C. × 3 min. | 21.0 | 32.0 | 50 | 1.6 | 3.0 |

*The largest drawing ratio which does not cause brittle cracking after deep-drawing.

The present invention has been described in detail in the foregoing, has the following distinguishing characteristics as compared with the prior art.

(a) A high temperature coiling operation is not required in the hot rolling process, and coiling a temperature of 650° C. or lower is feasible. Therefore the pickling or descaling efficiency is good and a high yield is possible. Further, even in the case of using a high coiling temperature as in the prior art, the quality at the top and bottom of the coil is excellent, resulting in a high yield;

(b) An energy saving due to the low slab reheating temperature is possible and also, the low temperature heating process improves the cold workability;

(c) Differently from the steel of the prior art, the cold rolling reduction is so easily raised that the productivity of the hot rolling process will be improved, energy saving is also possible at the same time, and deep-drawability will be more improved; and (d) By making an extremely low carbon steel, a cold rolled steel sheet favored with a combination of the highest degree of stretchability, deep drawability and secondary workability can be manufactured.

We claim:

1. A method for producing a cold rolled steel sheet having press formability, which comprises:

hot rolling, at a temperature of at least 850° C., and Al-killed, boron-free steel consisting of, by weight, not more than 0.07% C, 0.10–0.40%Mn, 0.010–0.050% Al, not more than 0.0020%N, not more than 0.010%P, and not more than 0.02%Si, wherein the relation between P and N is such that $P+5N \leqq 0.0175\%$, the remainder of the steel being Fe and unavoidable impurities, cold rolling the hot rolled steel at a reduction of at least 50%, and subjecting the cold rolled steel to recrystallization continuous annealing at a temperature between the recrystallization temperature and the $A_3$ point for not longer than five minutes.

2. A cold rolled, continuously annealed boron-free steel sheet having press formability, consisting of, by weight, not more than 0.07%C, 0.10–0.40%Mn, 0.10–0.50%Al, not more than 0.0020%N, not more than 0.010%P, and not more than 0.02%Si, wherein the relation between P and N is such that $P+5N \leqq 0.0175\%$, the remainder of the steel being Fe and unavoidable impurities.

3. A method for producing a cold rolled steel sheet having press formability, which comprises:

hot rolling, at a temperature of at least 850° C., an Al-killed, boron-free steel consisting of, by weight, not more than 0.05%C, 0.10–0.40%Mn, 0.010–0.050% Al, not more than 0.0020%N, not more than 0.010%P, not more than 0.02%Si, and Cr in an amount of not more than 0.10%, wherein the relation between P and N is such that $P+5N \leqq 0.0175\%$, the remainder of the steel being Fe and unavoidable impurities, cold rolling the hot rolled steel at a reduction of at least 50%, and subjecting the cold rolled steel to recrystallization continuous annealing at a temperature between the recrystallization temperature and the $A_3$ point for not longer than five minutes.

4. A method for producing a cold rolled steel sheet having press formability, which comprises:

hot rolling, at a temperature of at least 850° C., an Al-killed, boron-free steel consisting of, by weight, not more than 0.005%C, 0.10–0.40%Mn, 0.010–0.050%Al, not more than 0.0020%N, not more than 0.010%P, not more than 0.02%Si, and at least one element selected from not more than 0.10% Ti and not more than 0.10% Nb, wherein the relation between P and N is such that $P+5N \leqq 0.175\%$, and the relation between P and C is such that $P \leqq 4C$, the remainder of the steel being Fe and unavoidable impurities, coiling the hot rolled steel at a temperature of 550°–650° C., cold rolling the hot rolled steel at a reduction of at least 50%, and subjecting the cold rolled steel to recrystallization continuous annealing at a temperature between the recrystallization temperature and the $A_3$ point for not longer than five minutes.

5. A cold rolled, continuously annealed boron-free steel sheet having press formability, consisting of, by weight, not more than 0.005%C, 0.10–0.40%Mn, 0.010–0.050%Al, not more than 0.020%N, not more than 0.010%P, not more than 0.02%Si, and at least one element selected from not more than 0.10%Ti and not more than 0.10%Nb, wherein the relation between P and N is such that $P+5N \leqq 0.0175\%$, and the relation between P and C is such that $P \leqq 4C$, the remainder of the steel being Fe and unavoidable impurities.

6. A method as claimed in claim 1 in which said C is not more than 0.05% by weight.

7. A method as claimed in claim 1 in which said C is not more than 0.005% by weight and the relation between said P and said C is $P \leqq 4C$.

8. A steel sheet as claimed in claim 2 in which said C is not more than 0.005% by weight and the relation between P and C is $P \leqq 4C$.

* * * * *